US010196078B2

(12) United States Patent
Shubs, Jr. et al.

(10) Patent No.: US 10,196,078 B2
(45) **Date of Patent: *Feb. 5, 2019**

(54) DIAGNOSTIC SYSTEM FOR A RAIL VEHICLE

(71) Applicant: Progress Rail Locomotive Inc., LaGrange, IL (US)

(72) Inventors: Alexander Shubs, Jr., Chicago, IL (US); David Matthew Roenspies, Elburn, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 406 days.

This patent is subject to a terminal disclaimer.

(21) Appl. No.: 14/954,047

(22) Filed: Nov. 30, 2015

(65) Prior Publication Data

US 2017/0151971 A1 Jun. 1, 2017

(51) Int. Cl.

| | |
|---|---|
| ***B61L 27/00*** | (2006.01) |
| ***B61L 25/02*** | (2006.01) |
| ***B61L 15/00*** | (2006.01) |

(52) U.S. Cl.

CPC ..... *B61L 27/0094* (2013.01); *B61L 15/0027* (2013.01); *B61L 15/0081* (2013.01); (Continued)

(58) Field of Classification Search

CPC .. B61L 25/025; B61L 25/028; B61L 27/0077; B61L 27/0083; B61L 27/0094

See application file for complete search history.

(56) References Cited

U.S. PATENT DOCUMENTS 5,445,347 A 8/1995 Ng
7,292,144 B2 11/2007 Ballinger
(Continued)

FOREIGN PATENT DOCUMENTS

CN 203391804 U 1/2014
WO WO 2014/147563 A1 9/2014
(Continued)

OTHER PUBLICATIONS

U.S. Patent Application titled "A Diagnostic System for a Rail Vehicle," filed Nov. 30, 2015.

*Primary Examiner* — Zachary L Kuhfuss
(74) *Attorney, Agent, or Firm* — Finnegan, Henderson, Farabow, Garrett & Dunner, LLP

(57) ABSTRACT

A visual diagnostic system for a rail vehicle having multiple assets is disclosed. The visual diagnostic system may have a data interface configured to receive a data stream from a wayside unit. The data stream includes values of a plurality of parameters measured made by the wayside unit. The data interface may also be configured to receive geo-information and configuration-information. The system further includes a memory device configured to store the data stream and a controller configured to determine, from the geo-information and the configuration-information, a geographic location of each of the multiple assets. The controller is further configured to determine prognostic information associated with an operational status of each of the multiple assets. The controller may further render for display in a user interface a visual representation of the rail vehicle with the prognostic information for each asset of the rail vehicle.

20 Claims, 7 Drawing Sheets

(52) U.S. Cl.
CPC ..... *B61L 25/025* (2013.01); *B61L 25/028* (2013.01); *B61L 27/0077* (2013.01); *B61L 2205/02* (2013.01)

(56) References Cited

U.S. PATENT DOCUMENTS

| | | | | |
|---|---|---|---|---|
| 7,659,972 | B2 | 2/2010 | Magnus et al. | |
| 8,209,145 | B2 | 6/2012 | Pagliuco et al. | |
| 8,245,983 | B2 | 8/2012 | Gilbertson | |
| 8,818,585 | B2 | 8/2014 | Bartonek et al. | |
| 8,849,732 | B2 * | 9/2014 | Raileanu ..... | B61L 27/0094 706/12 |
| 8,942,903 | B2 | 1/2015 | Friesen et al. | |
| 9,049,433 | B1 | 6/2015 | Prince | |
| 2007/0043486 | A1 | 2/2007 | Moffett et al. | |
| 2012/0274772 | A1 | 11/2012 | Fosburgh et al. | |
| 2013/0013138 | A1 | 1/2013 | Lu et al. | |
| 2013/0312524 | A1 | 11/2013 | Mian et al. | |
| 2014/0110535 | A1 | 4/2014 | Bartonek | |
| 2014/0110536 | A1 | 4/2014 | Bartonek | |
| 2014/0110537 | A1 | 4/2014 | Bartonek | |
| 2014/0200952 | A1 | 7/2014 | Hampapur et al. | |
| 2015/0217790 | A1 * | 8/2015 | Golden ..... | B61L 15/0072 701/19 |

FOREIGN PATENT DOCUMENTS

| | | | |
|---|---|---|---|
| WO | WO 2014/193610 | A1 | 12/2014 |
| WO | WO 2016/025188 | A2 | 2/2015 |

* cited by examiner

DIAGNOSTIC SYSTEM FOR A RAIL VEHICLE

TECHNICAL FIELD

This disclosure relates generally to a diagnostic system and, more particularly, to a visual diagnostic system for providing information on specific assets of a rail vehicle.

BACKGROUND

A railroad network includes a network of tracks that is used by a large number of rail vehicles. The operation of rail vehicles can be monitored by a remote off-board controller (also sometimes referred to as the "back office"). The off-board controller monitors the operation of rail vehicles using large amounts of data received from each rail vehicle and from stationary wayside units positioned at fixed locations throughout the railroad network. The ability to analyze and interpret these large amounts of data has the potential to be of great value in monitoring the condition of the rail vehicles.

Usually rail vehicles have multiple assets, for example, a train may have locomotive and non-locomotive vehicles linked together as one. Each asset includes multiple components that are susceptible to wear and breakdown resulting from everyday use. The rail vehicles and wayside unit are typically equipped with sensors for measuring various operating conditions. However, it is difficult to correlate the large amounts of retrieved data with the identity of the corresponding assets. Therefore, many prior systems only consider abnormal conditions where out-of-range operating values are detected.

One system that attempts to facilitate information use from wayside units is described in U.S. Pat. No. 8,245,983 (the '983 patent) that issued to Gilbertson, on Aug. 21, 2012. The '983 patent discloses a system for communicating information between a wayside unit and an on-board train operator. The '983 patent aims to minimize radio congestion by providing a wayside system and an onboard communication device configured to transmit/receive wayside data via a dispatch voice channel.

Although the system of the '983 patent may help the train operator to utilize the data from the wayside unit, it may be limited. Specifically, the system of the '983 patent may be effective in a situation where the hack office is overloaded with data and not capable of informing an individual train with relevant data. However, large amounts of data may still be lost. As a result, potential issues can be overlooked and the option of taking preemptive actions diminishes.

The disclosed visual diagnostic system is directed to overcoming one or more of the problems set forth above.

SUMMARY

In one aspect, the present disclosure is directed to a visual diagnostic system for a rail vehicle having multiple assets. The visual diagnostic system may include a data interface configured to receive a data stream from a wayside unit, wherein the data stream includes values of a plurality of parameters measured made by the wayside unit. The data interface may further be configured to receive geo-information associated with a geographic location of the rail vehicle, and to receive configuration-information associated with an arrangement of the multiple assets in the rail vehicle. The visual diagnostic system may also include a memory device configured to store the data stream and a controller in communication with the data interface and the memory device. The controller may be configured to determine, from the geo-information and the configuration-information, a geographic location of each of the multiple assets of the rail vehicle. The controller may also be configured to determine, from the received data stream and the determined geographic location of each of the multiple assets, prognostic information associated with an operational status of each of the multiple assets. The controller may further be configured to render for display in a user interface a visual representation of the rail vehicle with the prognostic information associated with the operational status for each asset of the rail vehicle.

In another aspect, the present disclosure is directed to a method for providing visual information on a rail vehicle having multiple assets. The method may include receiving a data stream from a wayside unit, wherein the data stream includes values of a plurality of parameters measured made by the wayside unit. The method may also include receiving geo-information associated with a geographic location of the rail vehicle, and receiving configuration-information associated with an arrangement of the multiple assets in the rail vehicle. The method may further include determining, from the geo-information and the configuration-information, a geographic location of each of the multiple assets. The method may also include determining, from the received data stream and the determined geographic location of each of the multiple assets, prognostic information associated with, an operational status of each of the multiple assets. The method may also include rendering for display in a user interface a visual representation of the rail vehicle with the prognostic information associated with the operational status for each of the multiple assets of the rail vehicle.

In yet another aspect, the present disclosure is directed to a computer programmable medium having executable instructions stored thereon for completing a method of providing visual information on a rail vehicle having multiple assets. The method may include receiving a data stream from a wayside unit, wherein the data stream includes values of a plurality of parameters measured made by the wayside unit. The method may also include receiving geo-information associated with a geographic location of the rail vehicle, and receiving configuration-information associated with an arrangement of the multiple assets in the rail vehicle. The method may further include determining, from the geo-information and the configuration-information, a geographic location of each of the multiple assets. The method may also include determining, from the received data stream and the determined geographic location of each of the multiple assets, prognostic information associated with an operational status of each of the multiple assets. The method may also include rendering for display in a user interface a visual representation of the rail vehicle with the prognostic information associated with the operational status for each of the multiple assets of the rail vehicle.

DETAILED DESCRIPTION

Figure 1:
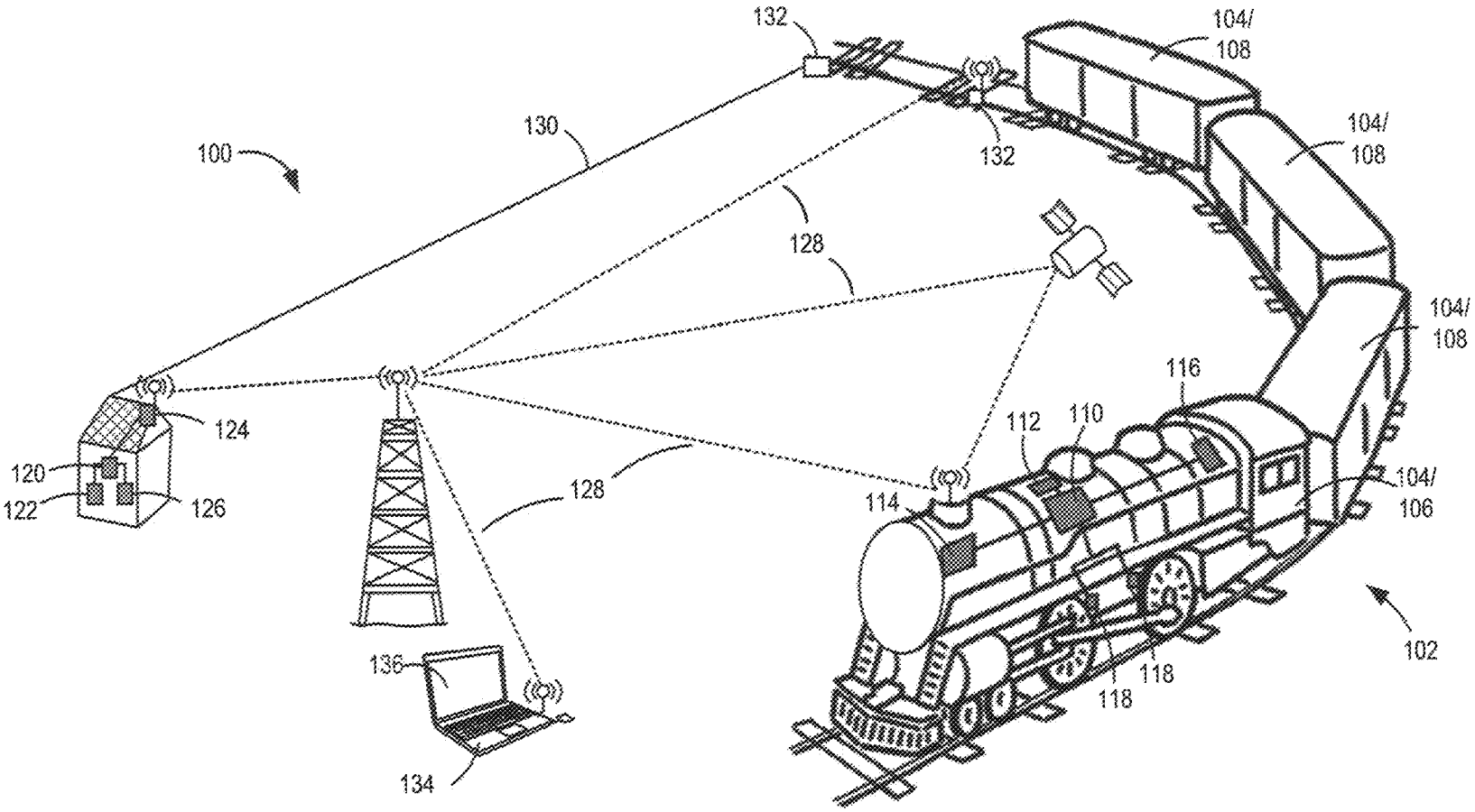
FIG. 1 is a schematic illustration of a rail vehicle and a visual diagnostic system, according to embodiments of the present disclosure.

FIG. 1 is a schematic diagram of a visual diagnostic system 100 for a rail vehicle, such as a train 102 traveling along a railroad network. Train 102 may include multiple assets 104, such as any number of locomotives and non-locomotive rail vehicles linked together. In the example illustrated in FIG. 1, train 102 includes a single powered locomotive 106 (e.g., an electrical-powered car, a diesel-powered car, or another type of car configured to power train 102) and three wagons 108 (e.g., a passenger car, a cargo container car, or another type of car capable of traveling on the railroad network). The railroad network may include any type of transportation pathway (e.g., railroad tracks, subway rails, or trolley tracks) on which train 102 may travel.

System 100 may include one or more components that cooperate to collect, communicate, process, and display information about the operational status of train 102. The operational status of train 102 may include the operational status of assets 104 and the operational status of the components of assets 104. System 100 may include an on-board system located on train 102 for directly monitoring the operation and condition of train 102. For example, the on-board system may include an on-board controller 110, a memory device 112, a data interface 114, a user interface 116, and a plurality of sensors 118. The various components in the on-board system may be coupled by one or more communication buses or signal lines. Additionally or alternatively, system 100 may include an off-board system located in a back office for monitoring the operation and condition of train 102. The off-board system may, for example, include an off-board controller 120, a memory device 122, a data interface 124, and a user interface 126. The various components in the back office may also be coupled by one or more communication buses or signal lines. It is contemplated that system 100 may include additional or different components than those illustrated in FIG. 1.

On-board controller 110 and off-board controller 120 may execute computer programs, applications, methods, processes, or other software to perform embodiments described in the present disclosure. The term "controller" may include any physical device having an electrical circuit that performs a logic operation on inputs. For example, on-board controller 110 and off board controller 120 may include one or more integrated circuits, microchips, microcontrollers, processors, microprocessors, all or part of a central processing unit (CPU), graphics processing unit (GPU), digital signal processor (DSP), field programmable gate array (FPGA), or other circuits suitable for executing instructions or performing logic operations.

Memory devices 112 and 122 may store information associated with operation and condition of train 102. The term "memory device" may include any non-transitory computer readable medium suitable for storing digital data or program code. Examples include random access memory (RAM), read-only memory (ROM), volatile memory, non-volatile memory, hard drives, CD ROMs, DVDs, flash drives, disks, and any other known physical storage medium. Memory devices 112 and 122 may include multiple structures, such a plurality of memories or computer-readable storage mediums located at train 102 or at a remote location. Memory devices 112 and 122 can store instructions for execution by on-board controller 110 and/or off-board controller 120, including instructions for causing them to perform steps consistent with embodiments of the present disclosure herein. As used herein, the term "and/or" means one or the other or both (e.g., A and/or B means A or B or both A and B).

Data interfaces 114 and 124 may facilitate communications regarding the operational status of train 102. The term "data interface" includes any device configured to receive digital data from one or more sources. Data interfaces 114 and 124 may include hardware and/or software that enables receiving and/or transmitting data messages through a wireless communication link 128 or a wired communication link 130. Wireless communications link 128 may include satellite, cellular, infrared, and any other type of wireless communications technology. Wireless communications link 128 may enable two-ways communication between on-board controller 110, off-board controller 120, wayside units 132, and a mobile terminal device 134. Data interfaces 114 and 124 may use one or more communication protocols to exchange data through wireless communication link 128. For example, data interfaces 114 and 124 may use Transmission Control Protocol (TCP), Internet Protocol (IP), TCP/IP, User Datagram Protocol (IDP), Internet Control Message Protocol (ICMP), or any other communication protocol.

In some embodiments, data interfaces 114 and 124 may receive geo-information associated with a geographic location of train 102, and configuration-information associated with an arrangement of multiple assets 104 in train 102. The term "geo-information" may include any position information associated with train 102. For example, geo-information may include coordinates or geographic location of at least of one of assets 104 relative to navigational devices such as satellites or other stations broadcasting navigational information, its time relative to such navigational broadcast stations, its relative distance from an RFID device, and/or its altitude. The term "configuration-information" may include any information associated with the arrangement of train 102. For example, the information may include the number of assets 104 in train 102, the order of multiple assets 104 within train 102, characterizing details of each of multiple assets 104 (e.g., ID number, length, color, size, and type), and more.

Data interfaces 114 and 124 may receive the gee-information from one or more sources and forward it to on-board controller 110 and/or off-board controller 120. On-board controller 110 and/or off-board controller 120 may use the received geo-information to determine the geographic location of each of assets 104 of train 102. For example the geo-information may be received from at least one of the following systems:

A Global Positioning System (GPS)—In some cases, a GPS sensor may be located on locomotive 106 or any other asset 104 to determine its location. The determined location of a single asset 104 may be used as representative of the location of train 102. Additionally, when coupled with the configuration-information, the location of a single asset 104 can be used by on-board controller 110 and/or off-board controller 120 to determine the locations of every other asset within train 102. En other embodiments, any or all assets 104 may be fitted with GPS sensors in order to determine the locations of those assets 104 directly.

An Automatic Equipment Identification (AEI) system—In some cases, at least some of assets 104 may include RFID tags, and system 100 may have a direct or indirect access to one or more wayside units 132 that include RFID readers.

These wayside units may be deployed at fixed, known locations along a railway. As train 102 passes these wayside units, the RFID readers may scan and recognize the identification information of passing assets 104. Knowledge of the time of the asset identification as well as the geographic location of wayside units 132 enables a determination of the location of a particular asset 104 at a specific time. Additionally, when coupled with the configuration-information, the location of the particular asset 104 at the specific time can be used to determine the locations of all other assets 104 in train 102 at the specific time.

An Automatic Train Protection (ATP) system—In some cases, system 100 may have a direct or indirect access to an electronic transponder (e.g., balises, beacons, or antennas) that may be part of wayside unit 132. The electronic transponder may be designed to notify train 102 of its exact location, the distance to the next signal, and can warn of any speed restrictions or special conditions, such as curves and gradients. A receiver on a particular asset 104 on train 102 may pick up the signal from the electronic transponder and, using its known location, enable the determination of the location of the particular asset 104 comprising the receiver at the time of communication with the electronic transponder. The ATP system provides a high level of accuracy, as the reading range may be limited to about 0.75 m. A successful communication with the electronic transponder may indicate a location of the particular asset 104 within about 1.5 m accuracy.

A video monitoring system—In some cases, system 100 may have a direct or indirect access to at least one camera that captures passing rail vehicles, such as train 102. Various image processing algorithms may be applied to associated video feeds to determine locations of assets 104 of passing train 102. The at least one camera may be installed at a fixed geographic location, e.g., wayside unit 132. Alternatively, the at least one camera may be included on moving assets 104 with a GPS sensor. The information from the video feeds may enable a determination of the location of all assets 104 when train 102 passes the at least one camera.

Data interfaces 114 and 124 may also receive the configuration-information from one or more sources and forward it to on-board controller 110 and/or off-board controller 120. On-board controller 110 and/or off-board controller 120 may use the received configuration-information to determine the geographic location of each asset 104 of train 102. For example the configuration-information may be received from at least one of the following systems:

An electronically controlled pneumatic (EPC) braking system—In some cases, system 100 may have a direct or indirect access to the ECP braking system of train 102. The ECP braking system may serve as a meaningful source of information for determining and tracking the configuration of train 102. Because the ECP braking system has the ability to communicate with each of multiple assets 104 and confirm that all assets 104 are present, the ECP braking system may be used to determine the ordering of assets 104.

A train scheduling system—In some cases, system 100 may have a direct or indirect access to a scheduling database that stores details about deployed trains 102 and their associated assets 104. The train scheduling system may keep track of any changes to the configuration-information of trains 102 included in the scheduling database.

An AEI system—The AEI system described above may also be used to determine the configuration-information of train 102. For example, the AEI system may monitor tag readings and determine the identification of assets 104 along with the order of those assets 104 within train 102.

A video monitoring system—The video monitoring system described above may also be used to determine the configuration-information of train 102. For example, the video monitoring system may apply image processing algorithms to identify assets 104 and the order of those assets 104 within train 102.

In some embodiments, the geo-information may be received from multiple sources (e.g., at least two independent systems, at least three independent systems). In addition, the configuration-information may also be received from multiple sources (e.g., at least two independent systems, at least three independent systems). On-board controller 110 and/or off-board controller 120 may separately aggregate the geo-information and the configuration-information from the different sources. Such aggregation may increase the confidence level in a determined location and configuration of train 102, especially where one or more data sources is temporary unavailable (e.g., out-of-range; not supported in a certain area of track, etc.). The aggregation can also reduce a response time for determining or updating a determined location and arrangement of train 102. For example, some sources of information (e.g., GPS, AEI system, etc.) may provide information useful for determining location and/configuration only at certain periodic (or even sporadic) rates. To fill in the gaps, different indicators of location and/or configuration from multiple sources may be relied upon to update location and configuration determinations more regularly than a single source may allow.

In other embodiments, data interfaces 114 and 124 may also receive messages and data streams from wayside units, such as wayside units 132. These messages and data streams may be communicated to on-board controller 110 and/or off-board controller 120 via data interfaces 114 and 124 for subsequent processing and analysis. The term "wayside unit" may include a portion of software, a portion of hardware, or a combination thereof that transmits a signal to a controller about a condition of a rail vehicle. For example, wayside unit 132 may include or be part of a hot bearing detector, a dragging equipment detector, a shifted load detector, a sliding wheel detector, or a wide-load detector. The messaged received from wayside unit 132 may indicate that at least one of assets 104 is experiencing an issue. For example, one message may indicate that a dimension of the at least one of assets 104 extends beyond a predetermined value. Another message may indicate that at least one of assets 104 is dragging an article below train 102. The data streams received from wayside unit 132 may include values of a plurality of parameters measured by wayside unit 132. For example, the data streams may include values of at least one of the following parameters: a bearing temperature, a wheel temperature, and a brake temperature. Additionally, the data streams may include values from a plurality of wayside units 132 physically separated from each other. For example, the data stream may include values from more than 10 wayside units 132, more than 50 wayside units 132, or more than 100 wayside units 132.

In yet other embodiments, data interfaces 114 and 124 may also receive signals from sensors 118. Sensors 118 may be distributed throughout train 102 and configured to gather data from various components, and subsystems of train 102. Some sensors 118 may be associated with specific components of train 102, for example, an engine, a generator, wheels, traction motors, a fuel supply, and more. Sensors 118 may monitor pressures, temperatures, volumes, voltages, currents, forces, speeds, and other parameters, and generate signals indicative of values of the parameters. Additionally, these signals may also indicate an operational status of sensors 118. In one aspect, the integrity, strength, and nature of the signals received from sensors 118 may indicate whether the respective components and/or subsystems are functioning properly. For example, different signal intensity thresholds may indicate a good condition, a moderate condition, a poor condition, a failed condition, etc. These signals may be communicated to on-board controller 110 and/or off-board controller 120 via data interfaces 114 and 124 for subsequent processing and analysis.

On-board controller 110 and off-board controller 120 may use all or some of the messages, data streams, and signals received at data interfaces 114 and/or 124 to determine prognostic information associated with specific assets 104. The term "prognostic information" may include any information associated with the operational status of a specific asset 104, or any information associated with the operational status of a specific component of asset 104. In some embodiments, the prognostic information may include an identification of which of assets 104 is experiencing an issue. In one example, the issue may be that a dimension of at least one of assets 104 extends beyond a predetermined value (also known as being out-of-gauge), in another example, the issue may be that at least one of assets 104 is dragging an article (e.g., a wire, chain, piece of debris, etc.) below train 102. In other embodiments, the prognostic information may include presentation of measured data. This includes, for example, presentation of values of at least one of the following parameters: a bearing temperature, a wheel temperature, and a brake temperature. Accordingly, system 100 may provide prognostic information regarding a current and a past operational status of one or more components of specific asset 104. Thus, rather than just providing an indication to a user that a component is operating outside a normal limit, system 100 can provide a user with visual information showing that the component is trending toward an operational issue such as a malfunction.

Consistent with embodiments of the present disclosure, on-board controller 110 and/or off-board controller 120 may render for display the prognostic information in user interface 116, 126. Additionally or alternatively, on-board controller 110 and/or off-board controller 120 may render for display the prognostic information in a user interface 136. The term "user interface" includes any hardware and software by which a user may interact with the on-board controller 110 and/or off-board controller 120, and the means by which the on-board controller 110 and/or off board controller 120 may convey information to the user. In some embodiments, user interfaces 116, 126, and 136 may include an input device (for example, a keyboard, a touch screen, a microphone, and a camera). Accordingly, user interfaces 116, 126, and 136 may receive input from the input device, and generate corresponding command signals in response to the input. These command signals may be communicated to on-board controller 110 and/or off-board controller 120 for processing. The input may include a selection of a specific asset 104 or a specific component. The input may also include additional information to be incorporated in determining the prognostic information. This includes, for example, the last time a component was replaced, visual impairments, and more.

User interfaces 116, 126, and 136 may also include an output device (for example, a speaker or a screen). Accordingly, user interfaces 116, 126, and 136 may audibly or visually convey at least part of the prognostic information to different users. In some embodiments, user interfaces 116, 126, and 136 may display a visual representation of a rail vehicle, such as train 102. The term "visual representation of a rail vehicle" may include a combination of numbers and letters, a list of multiple assets 104, or a graphical representation of at least one asset 104. In some embodiments, user interfaces 116, 126, and 136 may be part of one or more computing systems that interact with users. The one or more computing systems may include, for example, a laptop computer, a tablet, a smartphone, a control panel, and other computing systems known in the art.

Figure 2:
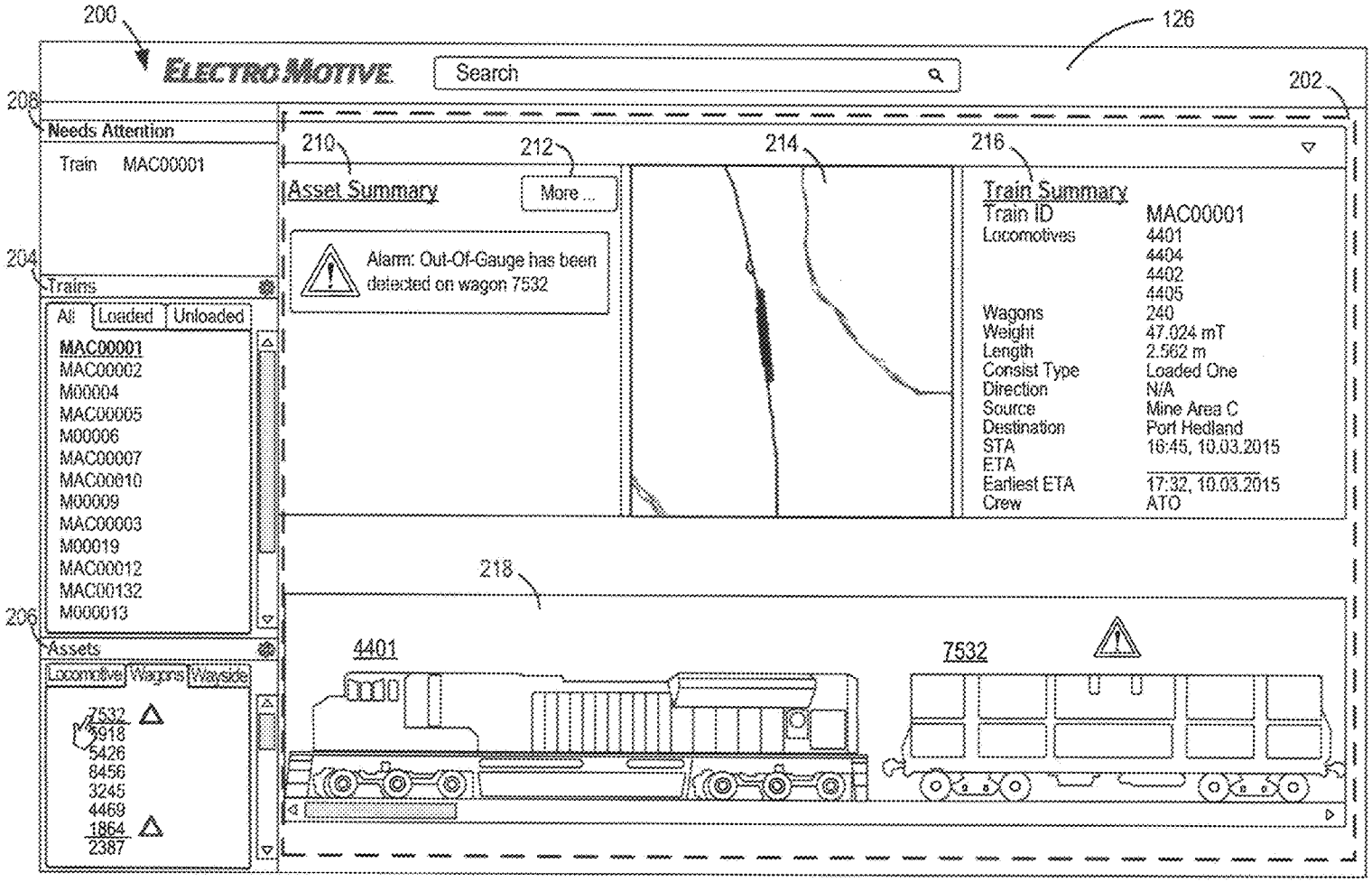
FIGS. 2-5 are schematic representations of exemplary disclosed graphical user interfaces (GUIs) that may be used in conjunction with the visual diagnostic system of FIG. 1.
Figure 3:
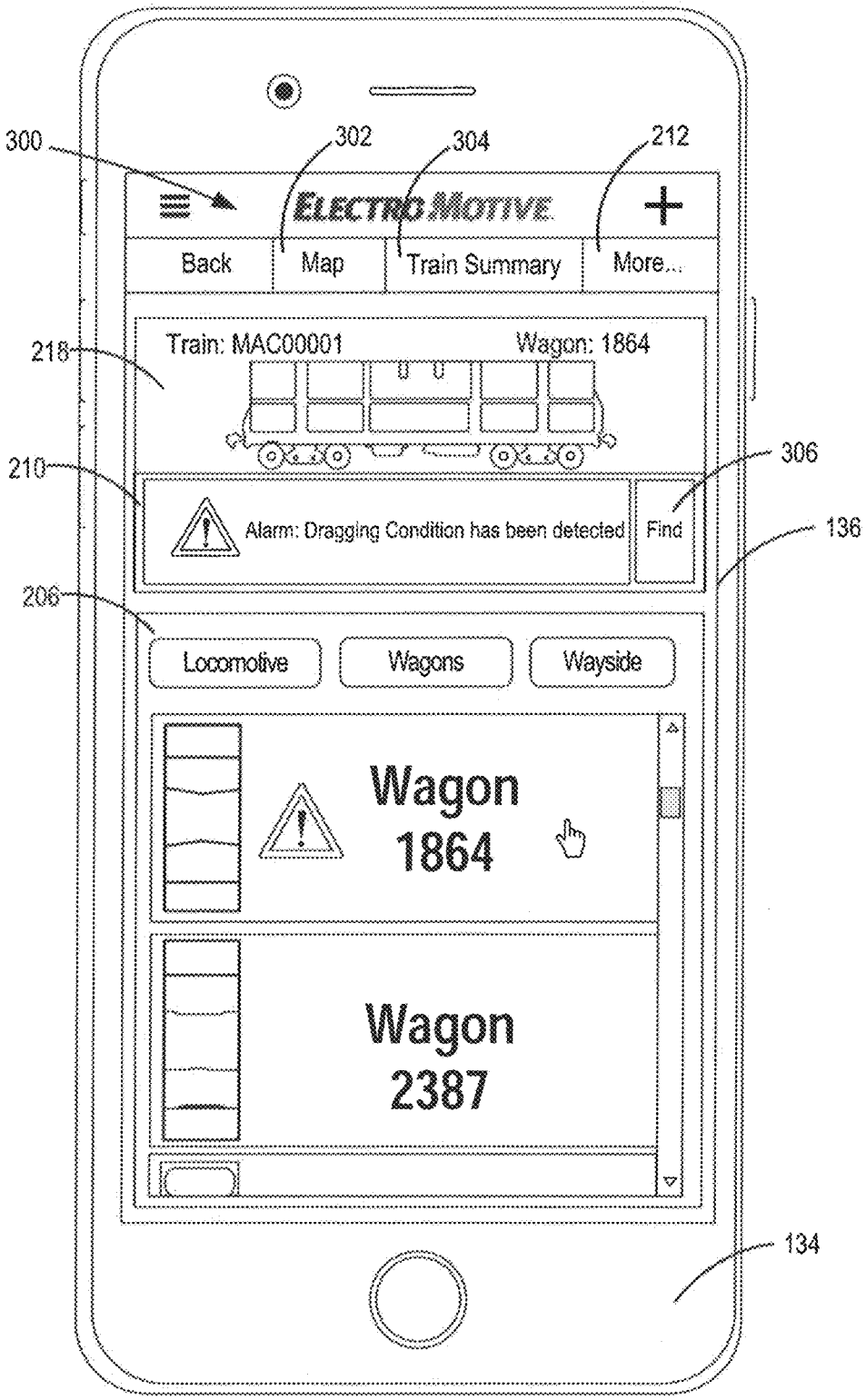
Figure 4:
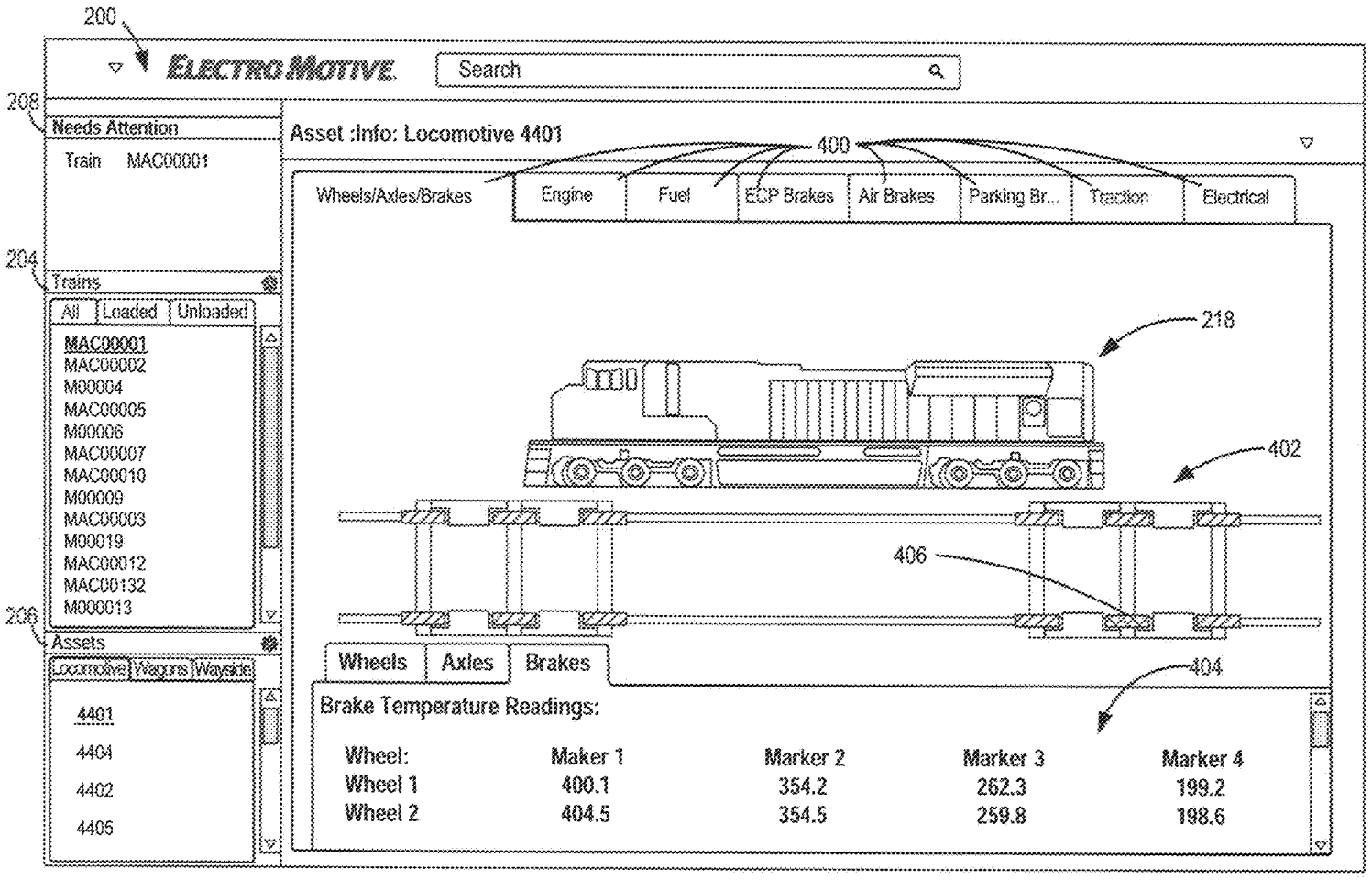
Figure 5:
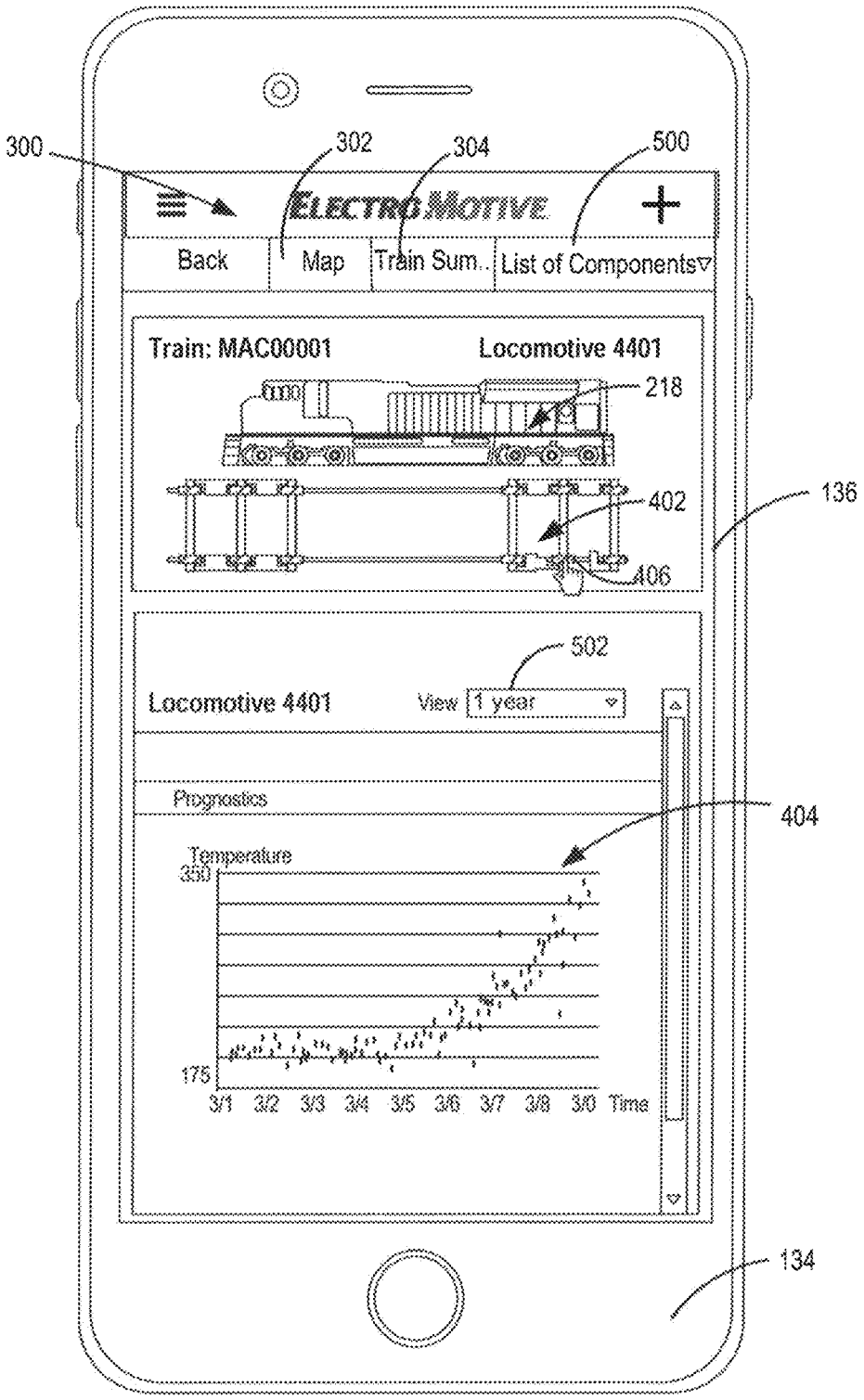

FIGS. 2-5 are schematic representations of exemplary disclosed graphical user interfaces (GUIs) that may be used in conjunction with system 100. FIGS. 2 and 4 illustrate a GUI 200 that may be displayed on user interface 126 being located at the back office. FIGS. 3 and 5 illustrate a GUI 300 that may be displayed on user interface 136 being part of mobile terminal device 134. A GUI that is displayed on an on-board screen being part of user interface 116 is not shown, but in several aspects it may be similar to GUI 300.

As shown in FIG. 2, GUI 200 may include one or more selectable lists to allow the user to choose the information to be presented on display area 202. For example, GUI 200 may include a trains list 204 and an assets list 206. The user may select a train 102 or an asset 104 from trains list 204 and assets list 206. Thereafter, GUI 200 may present prognostic information regarding the selected train 102 or selected asset 104. In some aspects, an attention list 208 may also be provided in GUI 200 to show specific trains 102 and/or specific assets 104 that require the user's attention.

Trains list 204 may show every train 102 associated with the back office. The user may select one or more trains 102 in trains list 204. By selecting a particular train 102 in trains list 204, prognostic information associated with the selected train 102 may be shown on display area 202. The user may filter the results shown in trains list 204 based on their loading status (i.e., unloaded, loaded, and all). In the example illustrated in FIG. 2 train number MAC00001 was previously selected.

Assets list 206 may show multiple assets 104 associated with a selected train 102. In one example, assets list 206 may include any number of locomotives 106, wagons 108, and/or wayside units 132 associated with a particular train 102. Assets list 206 may include a warning icon adjacent at least one asset 104. The warning icon adjacent a particular asset 104 may be used as an identification that this particular asset 104 is experiencing an issue. By selecting an asset 104 in assets list 206, GUI 200 may present prognostic information associated with the selected asset 104 in display area 202. In the example illustrated in FIG. 2, wagon No. 7532 and wagon No. 1864 have warning icons, and wagon No. 7532 was selected by the user.

Attention list 208 may show at least one train 102 that requires the user's attention. For example, attention list 208 may display any train 102 with at least one asset 104 currently experiencing a fault condition. By using the information received at data interfaces 114 and/or 124, on-board controller 110 and/or off-board controller 120 may determine that a particular train 102 has one or more assets 104 currently experiencing an issue, such as a fault condition. Accordingly, these trains 102 may be displayed on attention list 208 to draw the user's attention to trains 102 experiencing fault conditions. For example, as shown in FIG. 2, because train No. MAC0001 has one or more assets 104 experiencing at least one fault condition, train No. MAC0001 is displayed in attention list 208. The user may then be able to select the respective trains 102 on attention list 208 to show more prognostic information about the selected train 102 in GUI 200.

In some aspects, by selecting a particular train 102 from trains list 204 or attention list 208, GUI 200 may show data related to the selected train 102 in display area 202. Display area 202 may include an asset summary region 210, a button 212, an electronic map 214, a train summary region 216, and an asset graphical representation 218.

Asset summary region 210 may show prognostic information associated with assets 104 of a previously-selected train 102 that require the user's attention. Alternatively, asset summary region 210 may show prognostic information associated only with an asset 104 previously selected on assets list 206. In the example illustrated in FIG. 2, asset summary region 210 may include prognostic information in the form of an identification that a dimension of wagon No. 7532 extends beyond a predetermined value. Asset summary region 210 does not include a warning regarding wagon No. 1864 because, in this example, the user previously selected wagon No. 7532.

Electronic map 214 may be a two or three-dimensional graphical representation of the railroad network, with the location of train 102 marked on the representation. On-board controller 110 and/or off-board controller 120 may be configured to automatically generate and/or update the representation of the railroad network, including the location of train 102, in real time during operation of train 102. In some aspects, electronic map 214 may alternatively associate a different color with each train 102 depending on its operational status. For example, if train 102 is experiencing an issue, train 102 may be shown in red. Or, if train 102 has a risk of experiencing at least one fault condition, but is not currently experiencing a fault condition, train 102 may be shown in yellow. Further, if train 102 is experiencing normal conditions, train 102 may be shown in green. It is contemplated that electronic map 214 may alternatively associate other known visual indicators with trains 102 to help the user to identify the operational status of each train 102 on electronic map 214.

Train summary region 216 may display data relating to a selected train 102. In some embodiments, the data may be extracted from a plurality of databases. As shown in FIG. 2, the data may include, for example, a train identification ("Train ID"), a list of locomotives 106 associated with train 102, the number of wagons 108 associated with train 102, the overall, weight of train 102, the overall length of train 102, the consist type associated with train 102, the direction of train 102, the source of train 102, the destination of train 102, the estimated time of arrival ("ETA") of train 102, and/or a crew associated with train 102. FIG. 2 illustrates an exemplary set of display data relating to train No. MAC0001 at one moment in time. However, it is contemplated that the information in train summary region 216 may be updated in real-time via on-hoard controller 110 and/or off-board controller 120.

Asset graphical representation 218 may be used to present at least part of assets 104. In one embodiment, asset graphical representation 218 may be configured to illustrate the asset selected in assets list 206 and at least one more adjacent asset 104. In the example illustrated in FIG. 2, the selected asset is wagon No. 7532 and asset graphical representation 218 illustrates locomotive No. 4401 and wagon No. 7532. Asset graphical representation 218 may enable the user to browse between representations of all the assets of train 102 and to select one of them. The selection of an asset 104 in asset graphical representation 218 may have the same result as pressing button 212 (described below). In another embodiment, asset graphical representation 218 may be configured to illustrate only the asset selected in assets list 206. This embodiment is especially relevant when the user interface has a size-limited output device, such as a smartphone.

FIG. 3 illustrates a case with the same details as described above, as it presented in a smartphone associated with a user being an operator of train No. MAC0001. In this example the user selected to receive prognostic information on wagon No. 1864, not on wagon No. 7532. GUI 300, as depicted in FIG. 3, includes another version of assets list 206, asset summary region 210, and asset graphical representation 218. Train summary region 216 and electronic map 214 are not shown in FIG. 3, but may be accessed using buttons 302 and 304. After selecting wagon No. 1864 in assets list 206, prognostic information in the form of a warning was presented in asset summary region 210. The warning indicates that a dragging condition has been detected for wagon No. 1864.

In some embodiments, prognostic information in the form of an indication, such as warnings, may be presented automatically to the user, i.e., without selection of an asset 104 in assets list 206. For example, the warnings: "Alarm: Out-of-Gauge has been detected on wagon 7532" and "Alarm: Dragging Condition has been detected on wagon 1864" may be provided automatically to the user after on-board controller 110 and/or off-board controller 120 determine that one of assets 104 is experiencing an issue. Accordingly, prognostic information in general, and issues related to warnings specificity, may be delivered as push notifications, text messages, email messages, or voice messages.

As shown in FIG. 3, asset summary region 210 may include a button 306 for physically finding asset 104 experiencing the issue. By pressing button 306, mobile terminal 134 may provide the user guidance to the current estimated location of selected asset 104. Mobile terminal 134 may use its own GPS sensor and the current estimated location of selected asset 104, as determined by on-board controller 110 and/or off-board controller 120. For example, upon pressing button 306 a map application may be opened in mobile terminal 134, and the estimated coordinates of asset 104 currently experiencing the issue are used as the destination. This function enables quick locating of an asset experiencing an issue, such as dragging an article or being out-of-gauge.

GUI 300 also include a version of button 212. Button 212 may have dual functionality based on status of selected asset 104. The first function happens when selected asset 104 is currently experiencing an issue (e.g., dragging an article or being out-of-gauge). In this case, pressing button 212 may provide additional details on the issue or additional details about the asset 104 experiencing the issue. The additional details about selected asset 104 (e.g., the type of asset 104, the color of asset 104, the ID number of asset 104, the distance of asset 104 from the locomotive, and more) may assist the user to physically identify asset 104 experiencing the issue. The second function happens when selected asset 104 is not currently experiencing an issue. In this case pressing button 212 may provide additional prognostic information on selected asset 104.

FIG. 4 shows GUI 200 when locomotive No. 4401 is selected in assets list 206, and button 212 is pressed to retrieve additional prognostic information. GUI 200 may include a plurality of tabs 400, each including prognostic information for a different subsystem of selected asset 104. In this example, GUI 200 includes the following tabs: Wheels/Axles/Brakes, Engine, Fuel, ECP Brakes, Air Brakes, Parking Brakes. Traction, and Electrical. The prognostic information for each subsystem may be collected from sensors 118 and/or wayside units 132. GUI 200 further includes asset graphical representation 218 of selected asset 104 that include a component graphical representation 402 and a results region 404.

Component graphical representation 402 may be a schematic top view of various components of selected asset 104. For example, component graphical representation 402 may show the wheel configuration of selected asset 104. In some embodiments, component graphical representation 402 may associate a different color with each component depending on its operational status. For example, if one wheel is experiencing at least one operational issue (such as a malfunction), it may be shown in red. If another wheel is still operating within normal ranges, but is trending toward an operational issue, it may be shown in yellow. And if a wheel is experiencing normal conditions, it may be shown in green. It is contemplated that component graphical representation 402 may alternatively or additionally associate other known visual indicators with the different component to help the user to identify the operational status of each component of selected asset 104. In the example illustrated in FIG. 4, wheel 406 has a different pattern than the rest of wheels.

Results region 404 may include different types of data representation associated with the prognostic information collected from sensors 118 and/or wayside units 132. The different types of data representation may include a chart, a graph, a slider bar, a text box, an image, and more. The user may have the option to change the type of data representation. In the example shown in FIG. 4, a chart is used for presenting the brake temperature readings per wheel. In some embodiments, the data representation in results region 404 may be updated in real-time to include the most recent values of parameters included in data streams received from wayside units 132. The chart in FIG. 4 includes the results from the last four measurements for all of the wheels of selected asset 104. Other types of data representation, such as the one illustrated in FIG. 5, may show more than the last four measurements results.

In FIG. 5, GUI 300 show results region 404 with a different type of data representation, which shows measurements results from the last year. GUI 300 includes another version of component graphical representation 402 and results region 404. Component graphical representation 402 may enable the user to select any component associated with prognostic information collected from sensors 118 and or wayside units 132. Alternatively, the user may use a combo box 500, which may open a list of all the available components, to select one component of interest. In the example illustrated in FIG. 5, wheel 406 was selected from component graphical representation 402. By selecting a certain component, GUI 300 may present prognostic information associated with the selected component in results region 404. In some embodiments, every type of component may be associated with a default type of data representation. In the example shown in FIG. 5, a graph is used for presenting the temperature of selected wheel 406.

Consistent with embodiments of the present disclosure, GUI 300 may present prognostic information aggregated from a plurality of data streams. The plurality of data streams may be collected over a period of time and/or received from a plurality of wayside units 132. The user may use a combo box 502 to change the time period for presenting the aggregated prognostic information. In some embodiment, every type of component may be associated with a default time period. As shown in FIG. 5, having GUI 300 presenting historical values of parameters may provide important insights regarding the operational status of the selected component. For example, assuming 350 degrees is a maintenance threshold value. Wheel 406 may not be recognized as having a malfunction because none of the values recorded in wayside units 132 were above 350 degrees. However, system 100 may analyze the aggregated prognostic information to identify that wheel 406 is likely to experience a malfunction in the near future.

One skilled in the art will realize that the processes illustrated in this description may be implemented in a variety of ways and include other modules, programs, applications, scripts, processes, threads, or code sections that may all functionally interrelate with each other to accomplish the individual tasks described above for each module, script, and daemon. For example, these programs modules may be implemented using commercially available software tools, using custom object-oriented code written in the C++ programming language, using applets written in the Java programming language, or may be implemented with discrete electrical components or as one or more hardwired application specific integrated circuits (ASIC) that are custom designed for this purpose.

The described implementation may include a particular network configuration but embodiments of the present disclosure may be implemented in a variety of data communication network environments using software, hardware, or a combination of hardware and software to provide the processing functions.

INDUSTRIAL APPLICABILITY

The disclosed visual diagnostic system may be applicable to any transportation network, including subways, trolleys, and railroads. The disclosed visual diagnostic system may increase efficiency in collecting, analyzing, and visually identifying the operational status of assets 104. In particular, the disclosed visual diagnostic system may allow a user to easily identify assets 104 experiencing an issue and/or components of assets 104 likely to experience a malfunction in the near future. The disclosed visual diagnostic system may also display graphical representations of trains 102 and/or assets 104 experiencing fault conditions to allow the user to respond to the fault conditions in an efficient manner. Two exemplary operations of the disclosed visual diagnostic system will now be described.

Figure 6:
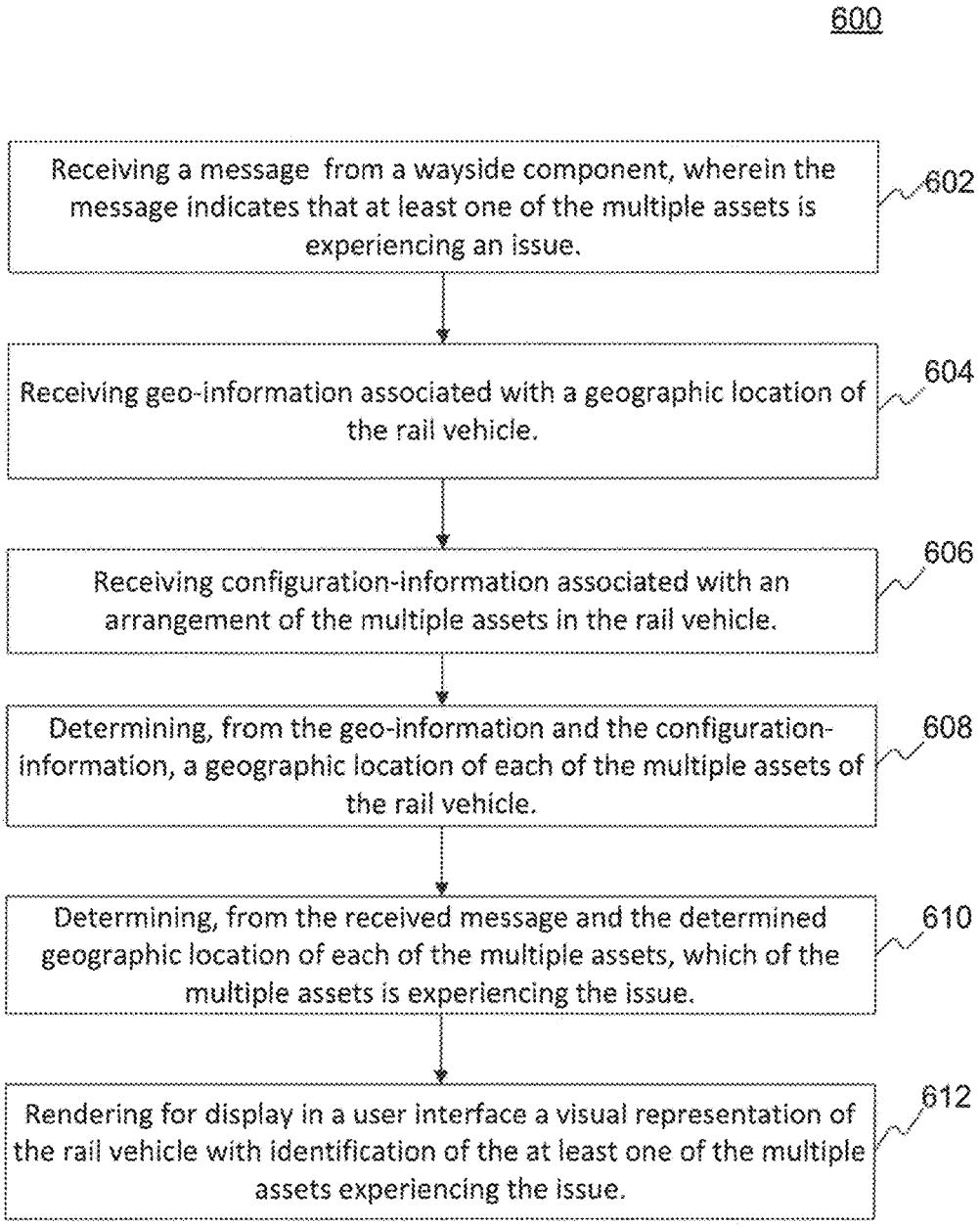
FIGS. 6-7 are flowcharts showing exemplary processes for providing visual information according to embodiments of the present disclosure.

FIG. 6 illustrates a flowchart of a process 600 for providing identification of an asset experiencing an issue. Process 600 begins at step 602, when data interface 114 and/or data interface 124 receives a message from wayside unit 132. The message may be received through wireless communication link 128 or through wired communication link 130. In some embodiments, the message may indicate that at least one of assets 104 is experiencing an issue. In a first example, the message indicates that a dimension of at least one of assets 104 extends beyond a predetermined value (also known as being out-of-gauge). In a second example, the message indicates that at least one of assets 104 is dragging an article (e.g., a wire, chain, piece of debris, etc.) below train 102.

At step 604, data interface 114 and/or data interface 124 may receive geo-information associated with a geographic location of a rail vehicle, such as train 102. As described above, the geo-information may be received from at least one of: a GPS located on the rail vehicle, an AEI system, an ATP system, and a video monitoring system. Additionally, in some embodiments, the geo-information may be received from multiple sources. The geo-information received from the multiple sources may be combined to increase the confidence level when determining the geographic location of multiple assets 104 of train 102.

At step 606, data interface 114 and/or data interface 124 may receive configuration-information associated with an arrangement of multiple assets 104 in the rail vehicle, such as train 102. As described above the configuration-information may be received from at least one of an EPC braking system, a train scheduling system, an AEI system, and a video monitoring system. Additionally, in some embodiments, the configuration-information may be received from multiple sources. The configuration-information received from the multiple sources may be combined to increase the confidence level when determining the arrangement of assets 104 in train 102.

At step 608, on-board controller 110 and/or off-board controller 120 may determine, from the geo-information and the configuration-information, a geographic location of each of multiple assets 104 of the rail vehicle, such as train 102. To determine the geographic location of each of assets 104, the geo-information may include at least one geographical location of one asset 104 and the configuration-information may include at least the order of assets 104 and their length. In some embodiments, the geo-information may be derived from measurements of the geographic location of only part of assets 104. In this embodiments, a knowledge of the time in which the measurements took place may be used in determining the geographic location of all of assets 104.

At step 610, on-board controller 110 and/or off-board controller 120 may determine, from the received message and the determined geographic location of each of multiple assets 104, which of multiple assets 104 is experiencing the issue. In some embodiments, the message may include geo-information associated with wayside unit 132. In other embodiments, the message may include a timestamp associated with the issue, and the geo-information includes timestamps of signals with data about the geographic location of train 102. Accordingly, on-board controller 110 and/or off-hoard controller 120 may determine which of assets 104 experienced the issue using the timestamp associated with the issue and the timestamps of the signals. The following simplified example may illustrate these embodiments. Train No. MAC0001, which is described in FIG. 2, has 4 locomotives and 240 wagons. Assuming only the first locomotive has a GPS sensor, and at moment $t_1$ a wayside unit located at point $x_1$ measures that one of the assets is experiencing an issue. The geo-information indicates that, at moment the first locomotive was located at point $x_2$ that is 400 feet ahead of point $x_1$. Using the configuration-information of train No. MAC0001, on-board controller 110 and/or off-board controller 120 may determine which asset was located 400 feet behind the first locomotive in moment $t_1$, and this asset would be the one experiencing the issue.

At step 612, on-board controller 110 and/or off-board controller 120 may render for display in a user interface a visual representation of the rail vehicle with identification of the at least one of multiple assets 104 experiencing the issue. In some embodiments, the identification of the at least one asset 104 may include an indicator (e.g., an icon), for example the warning sign in asset graphical representation 218. In other embodiments, the identification of the at least one asset 104 may include information about a type of the issue, for example the warning in asset summary region 210. In addition, the identification of an asset 104 may include one or more details about the asset 104, for example the type of asset 104, the color of asset 104, the ID number of asset 104, the distance of asset 104 from the locomotive, and more. In case a plurality of messages are received from a plurality of wayside units, on-board controller 110 and/or off-board controller 120 may render for display identifications of at least two of multiple assets 104 experiencing different issues. For example, assets list 206 includes two icons that identify assets 104 as experiencing different issues.

Figure 7:
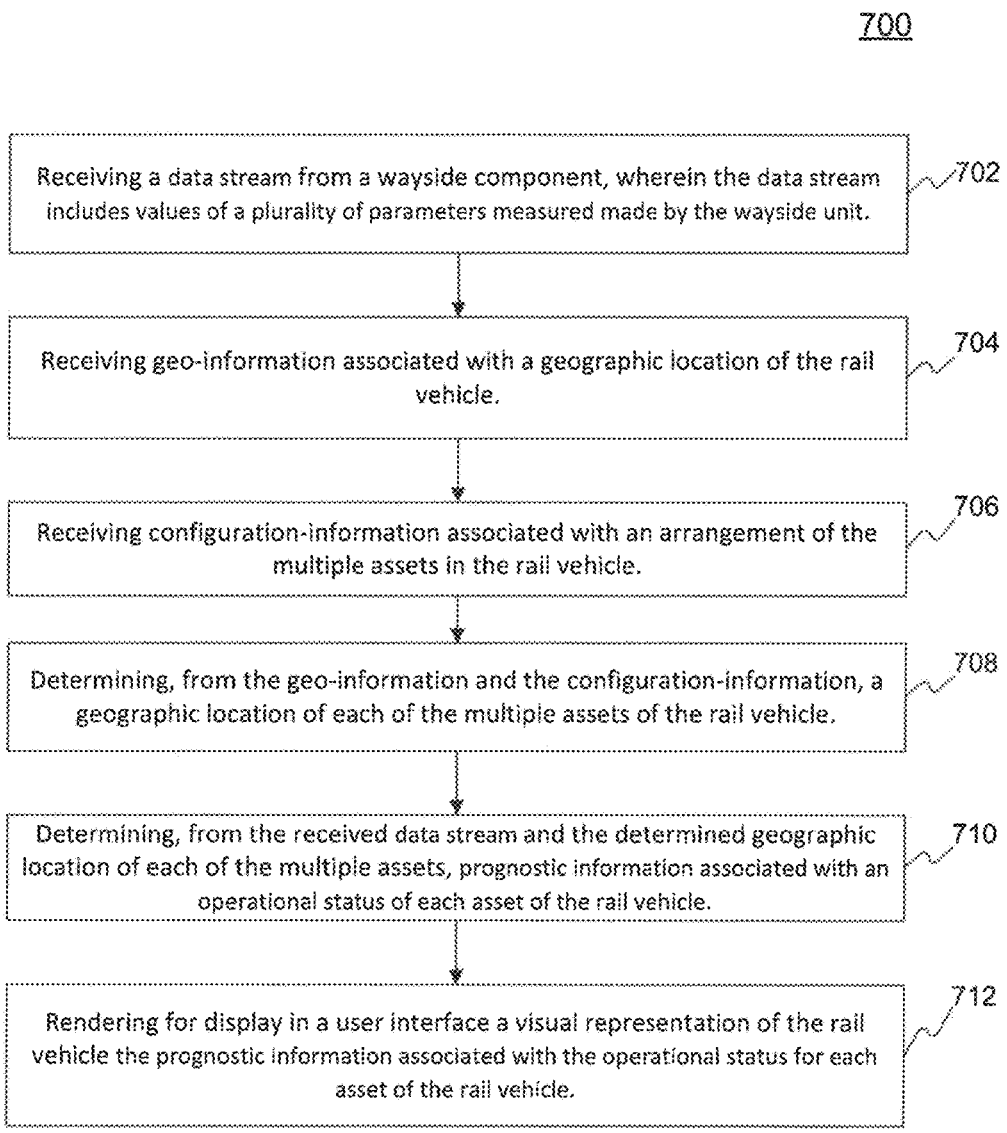

FIG. 7 illustrates a flowchart of a process 700 for providing prognostic information associated with the operational status train 102, and visual information about train 102 having multiple assets 104. Process 700 begins at step 702, when data interface 114 and/or data interface 124 receive a data stream from wayside unit 132 or from a plurality of wayside units 132 physically separated from each other. The data stream may be received through wireless communication link 128 or through wired communication link 130. In some embodiments, the data stream includes values of a plurality of parameters measured made by wayside unit 132. For example, the data stream may include values of at least one of the following parameters: a bearing temperature, a wheel temperature, and a brake temperature. Data interface 114 and/or data interface 124 may also be configured to receive one or more additional data streams, and to aggregate the information in the data streams to identify changes in the operational status for each of assets 104 over a period of time.

Steps 704-708 are similar in nature to steps 604-608. At step 710, on-board controller 110 and/or off-board controller 120 may determine prognostic information associated with an operational status of each asset 104 of train 102. The determination of the prognostic information may be based on the received data stream and the determined geographic location of each of multiple assets 104. In the example illustrated in FIG. 4, the prognostic information includes brake temperature readings for all the wheels of a specific asset 104. In some embodiments, the data stream may include timestamps associated with the measured parameters (for example, the time in which wayside unit 132 measured the parameters) and the geo-information includes timestamps of signals with data about the geographic location of train 102. In these embodiments, onboard controller 110 and/or off-board controller 120 may determine the operational status of each asset 104 of the rail vehicle using the timestamps associated with measured parameters and the timestamps of the signals.

At step 712, on-board controller 110 and/or off-board controller 120 may render for display in a user interface a visual representation of train 102 with the prognostic information associated with the operational status for each asset of train 102. In some embodiments, the prognostic information includes a current operational status of all bearings of at least one of multiple assets 104. In other embodiments, the prognostic information includes a current operational status and/or historical operational status of all bearings, wheels, or brakes of at least one of assets 104. In other embodiments, on-board controller 110 and/or off-board controller 120 may receive a selection of a specific component. And upon receiving the selection, on-board controller 110 and/or off-board controller 120 may render for display historical values for specific parameters associated with the selection.

It will be apparent to those skilled in the art that various modifications and variations can be made to the disclosed system 100 and the illustrated GUI 200 and 300. Other embodiments will be apparent to those skilled in the art from consideration of the specification and practice of the disclosed parts of the system. It is intended that the specification and examples be considered as exemplary only, with a true scope being indicated by the following claims and their equivalents.

What is claimed is:

1. A visual diagnostic system for a rail vehicle having multiple assets, comprising:
   a data interface configured to:
      receive a data stream from a wayside unit, wherein the data stream includes values of a plurality of parameters measured by the wayside unit;
      receive geo-information associated with a geographic location of the rail vehicle; and
      receive configuration-information including an order in which the multiple assets are arranged in the rail vehicle;
   a memory device configured to store the data stream; and
   a controller in communication with the data interface and the memory device, the controller being configured to:
      determine, from the geo-information and the configuration-information, a geographic location of each of the multiple assets;
      identify, from the received data stream and the determined geographic location of each of the multiple assets, an asset that is experiencing an operational status that is one of outside a normal limit or trending toward falling outside a normal limit, the asset being selected from the multiple assets; and
      render for display in a user interface a visual representation of the rail vehicle, the visual representation including a graphical icon associated with the identified asset.

2. The visual diagnostic system of claim 1, wherein the plurality of parameters includes at least one of: a bearing temperature, a wheel temperature, and a brake temperature.

3. The visual diagnostic system of claim 1, wherein the wayside unit is a first wayside unit and the data interface is further configured to receive an additional data stream from a second wayside unit, physically separated from the first wayside unit.

4. The visual diagnostic system of claim 1, wherein the data interface is configured to receive the geo-information from multiple sources, and the controller is further configured to combine the geo-information from the multiple sources when determining the geographic location of each of the multiple assets.

5. The visual diagnostic system of claim 1, wherein the data interface is configured to receive the geo-information from at least one of: a Global Positioning System (GPS) located on the rail vehicle, an Automatic Equipment Identification (AEI) system, an Automatic Train Protection (ATP) system, and a video monitoring system.

6. The visual diagnostic system of claim 1, wherein the data interface is configured to receive the configuration-information from multiple sources, and the controller is further configured to combine the configuration-information from the multiple sources when determining the geographic location of each of the multiple assets.

7. The visual diagnostic system of claim 1, wherein the data interface is configured to receive the configuration-information from at least one of: an electronically controlled pneumatic (EPC) braking system, a train scheduling system, an Automatic Equipment Identification (AEI) system, and a video monitoring system.

8. The visual diagnostic system of claim 1, wherein the controller is located on-board the rail vehicle, and the user interface is displayed on an on-board screen.

9. The visual diagnostic system of claim 1, wherein the controller is located at a remote location, and the user interface is displayed on a mobile terminal device.

10. The visual diagnostic system of claim 1, wherein:
   the data stream includes timestamps associated with the measured parameters;
   the geo-information includes timestamps of signals with data about the geographic location of the rail vehicle; and
   the controller is further configured to determine the operational status of each of the multiple assets using the timestamps associated with measured parameters and the timestamps of the signals.

11. The visual diagnostic system of claim 1, wherein the controller is further configured to render for display in the user interface information about a current operational status of all bearings of at least one of the multiple assets.

12. The visual diagnostic system of claim 1, wherein the controller is further configured to render for display in the user interface information about a current operational status of all wheels of at least one of the multiple assets.

13. The visual diagnostic system of claim 1, wherein the controller is further configured to:
   receive a selection of a specific component; and
   render for display in the user interface historical values for specific parameters associated with the selected component.

14. The visual diagnostic system of claim 1, wherein the data stream is a first data stream and:
   the data interface is further configured to receive at least a second data stream from the wayside unit;
   the memory device is further configured to store the at least the second data stream; and
   the controller is further configured to:
      aggregate prognostic information determined from the first and at least the second data streams; and
      render for display in the user interface the aggregated prognostic information associated with the operational status for each of the multiple assets.

15. The visual diagnostic system of claim 14, wherein the aggregated information represents changes in the operational status over a period of time.

16. A method for providing visual information on a rail vehicle having multiple assets, comprising:
   receiving a data stream from a wayside unit, wherein the data stream includes values of a plurality of parameters measured by the wayside unit;
   receiving geo-information associated with a geographic location of the rail vehicle;
   receiving configuration-information including an order in which the multiple assets are arranged in the rail vehicle;
   determining, from the geo-information and the configuration-information, a geographic location of each of the multiple assets;
   identifying, from the received data stream and the determined geographic location of each of the multiple assets, an asset that is experiencing an operational status that is one of outside a normal limit or trending toward falling outside a normal limit, the asset being selected from the multiple assets; and
   rendering for display in a user interface a visual representation of the rail vehicle, the visual representation including a graphical icon associated with the identified asset.

17. The method of claim 16, wherein the plurality of parameters includes at least one of: a bearing temperature, a wheel temperature, and a brake temperature.

18. The method of claim 16, wherein the wayside unit is a first wayside unit and the data interface is further configured to receive an additional data stream from a second wayside unit, physically separated from the first wayside unit.

19. The method of claim 16, further comprising:

receiving a selection of a specific component; and rendering for display in the user interface historical values for specific parameters associated with the selected component.

20. A computer programmable medium having executable instructions stored thereon for completing a method for providing visual information on a rail vehicle having multiple assets, the method comprising:

receiving a data stream from a wayside unit, wherein the data stream includes values of a plurality of parameters measured by the wayside unit;

receiving geo-information associated with a geographic location of the rail vehicle;

receiving configuration-information including an order in which the multiple assets are arranged in the rail vehicle;

determining, from the geo-information and the configuration-information, a geographic location of each of the multiple assets;

identifying, from the received data stream and the determined geographic location of each of the multiple assets, an asset that is experiencing an operational status that is one of outside a normal limit or trending toward falling outside a normal limit, the asset being selected from the multiple assets; and rendering for display in a user interface a visual representation of the rail vehicle, the visual representation including a graphical icon associated with the identified asset.

* * * * *